US008818225B2

(12) United States Patent
Samei et al.

(10) Patent No.: US 8,818,225 B2
(45) Date of Patent: Aug. 26, 2014

(54) TEMPERATURE CONTROL METHOD OF THERMAL FIXING DEVICE, THERMAL FIXING DEVICE, AND IMAGE FORMING APPARATUS

(75) Inventors: Masahiro Samei, Kanagawa (JP); Yasunori Ishigaya, Kanagawa (JP); Ryota Yamashina, Kanagawa (JP); Takumi Waida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 13/427,276

(22) Filed: Mar. 22, 2012

(65) Prior Publication Data

US 2012/0243895 A1 Sep. 27, 2012

(30) Foreign Application Priority Data

Mar. 23, 2011 (JP) ..... 2011-063898

(51) Int. Cl.
*G03G 15/20* (2006.01)

(52) U.S. Cl.
CPC .. *G03G 15/2039* (2013.01); *G03G 2215/00772* (2013.01)
USPC ..... 399/69; 399/67

(58) Field of Classification Search
CPC ..... G03G 15/2039; G03G 15/205; G03G 15/2078
USPC ..... 399/67, 69
See application file for complete search history.

(56) References Cited

U.S. PATENT DOCUMENTS 7,206,541 B2 * 4/2007 Fukita et al. ..... 399/328
7,844,192 B2 * 11/2010 Williams et al. ..... 399/67
7,912,392 B2 3/2011 Yoshinaga et al.
8,064,798 B2 11/2011 Shinshi et al.
8,073,352 B2 12/2011 Kunii et al.
8,150,289 B2 4/2012 Yamashina et al.
8,358,945 B2 * 1/2013 Kunii ..... 399/45

(Continued)

FOREIGN PATENT DOCUMENTS

JP 8-137341 5/1996
JP 2003-280447 10/2003
JP 2005-84419 3/2005
JP 2006-195422 7/2006

OTHER PUBLICATIONS

U.S. Appl. No. 13/252,543, filed Oct. 4, 2011, Yasunori Ishigaya, et al.

(Continued)

*Primary Examiner* — Walter L Lindsay, Jr.
*Assistant Examiner* — Philip Marcus T Fadul
(74) *Attorney, Agent, or Firm* — Oblon, Spivak, McClelland, Maier & Neustadt, L.L.P.

(57) ABSTRACT

A temperature control method of calculating a temperature of a recording medium after fixing and used in a thermal fixing device includes separating calculations of calculating the temperature of the recording medium after fixing into first-stage calculations to be performed before start of printing and second-stage calculations to be performed in real time during the printing, performing the first-stage calculations, and performing the second-stage calculations to calculate a result of the temperature of the recording medium after fixing. Further, the result of the temperature of the recording medium after fixing is used to control obtaining a desired temperature of the recording medium after fixing, and the temperature of the recording medium after fixing is calculated without directly measuring the temperature of the recording medium after fixing.

8 Claims, 10 Drawing Sheets

(56) References Cited

U.S. PATENT DOCUMENTS

| | | | | |
|---|---|---|---|---|
| 8,515,326 | B2 * | 8/2013 | Nakahara et al. | 399/329 |
| 2010/0061754 | A1 | 3/2010 | Ishigaya et al. | |
| 2010/0092220 | A1 | 4/2010 | Hasegawa et al. | |
| 2011/0052224 | A1 | 3/2011 | Yamashina et al. | |
| 2011/0064437 | A1 | 3/2011 | Yamashina et al. | |
| 2011/0091226 | A1 | 4/2011 | Ishigaya et al. | |
| 2011/0142472 | A1 * | 6/2011 | Mitsuoka et al. | 399/69 |
| 2011/0182634 | A1 | 7/2011 | Ishigaya et al. | |
| 2011/0206402 | A1 | 8/2011 | Yamashina | |
| 2011/0217057 | A1 | 9/2011 | Yoshinaga et al. | |
| 2011/0222927 | A1 | 9/2011 | Yamashina | |
| 2011/0274473 | A1 | 11/2011 | Shinshi et al. | |
| 2011/0299899 | A1 | 12/2011 | Ishigaya et al. | |

OTHER PUBLICATIONS

U.S. Appl. No. 13/272,629, filed Oct. 13, 2011, Takumi Waida, et al.

Masahiro Samei, et al., "Building of Simulation Technology of Model Based Development for Fuser Control", Imaging Conference Japan 2010 Fall Meeting, Technical Conference on Imaging Science of the Imaging Society of Japan, Nov. 26, 2010, 4 Pages (With English Abstract).

* cited by examiner

FIG.8A $$T_{t+1}(k) = B_O \cdot T_t(k) + B_U \cdot T_t(k+1) + B_D \cdot T_t(k-1)$$

MATRIX EXPRESSION $$\begin{bmatrix} X_{t+1}(m) \\ X_{t+1}(m-1) \\ \vdots \\ X_{t+1}(1) \end{bmatrix} = \begin{bmatrix} B_O & B_U & & & 0 \\ B_D & B_O & B_U & & \\ & B_D & \ddots & \ddots & \\ & & \ddots & \ddots & B_U \\ 0 & & & B_D & B_O & B_U \\ & & & & B_D & B_O \end{bmatrix} \begin{bmatrix} X_t(m) \\ X_t(m-1) \\ \vdots \\ X_t(1) \end{bmatrix}$$

$$X_{t+1} = A \cdot X_t$$

FIG.8B $$\theta(t+1) = A_t \theta(t)$$

MATRIX EXPRESSION $$\begin{bmatrix} X_{t+1}(m) \\ X_{t+1}(m-1) \\ \vdots \\ X_{t+1}(1) \end{bmatrix} = \begin{bmatrix} B_O & B_U & & & 0 \\ B_D & B_O & B_U & & \\ & B_D & \ddots & \ddots & \\ & & \ddots & \ddots & B_U \\ 0 & & & B_D & B_O & B_U \\ & & & & B_D & B_O \end{bmatrix} \begin{bmatrix} X_t(m) \\ X_t(m-1) \\ \vdots \\ X_t(1) \end{bmatrix}$$

$$X_{t+1} = A_t \cdot X_t$$

TEMPERATURE CONTROL METHOD OF THERMAL FIXING DEVICE, THERMAL FIXING DEVICE, AND IMAGE FORMING APPARATUS

CROSS-REFERENCE TO RELATED APPLICATIONS

The present application claims priority under 35 U.S.C §119 to Japanese Patent Application No. 2011-063898 filed Mar. 23, 2011, the entire contents of which are hereby incorporated herein by reference.

BACKGROUND OF THE INVENTION

1. Field of the Invention

The present invention generally relates to a temperature control method of controlling a temperature of a thermal fixing device provided in an image forming apparatus such as a copier, a printer, a facsimile machine, and a multi-function peripheral. More particularly, the present invention relates to a temperature control method of controlling a fixing device fixing the toner image onto a recording medium by heating a fixing member using a fixing heat source, contacting the heated fixing member with an imaging surface of the recording medium to melt a toner image formed on the image surface, a thermal fixing device employing the temperature control method, and an image forming apparatus including the thermal fixing device.

2. Description of the Related Art

In an image forming apparatus including a printer, a copier, a copier, a facsimile machine and the like, a fixing device has been widely used which fixes an image by heating and melting a toner image formed on a recording medium such as a sheet.

Generally, in such a fixing device for fixing an electrophotographic image formed as a toner image onto the recording medium, a fixing member such as a fixing belt is heated by supplying power to a heater as a fixing heat source, and the heat is used to heat and melt the toner image to be fixed onto the recording medium.

On the other hand, in such an image forming apparatus as described above, various types of recording media are used, including an ordinary sheet, a high-grade paper having a surface specially processed for letters, a resin sheet for an Over Head Projector (OHP) and the like.

Further, recently, the recording media used for image forming have various thicknesses and surface characteristics. Further, it is known that, in conventional fixing devices, the fixing characteristics and the image quality of the toner image formed on the recording media may vary depending on the types of the recording media.

Japanese Laid-open Patent Publication No. 08-137341 discloses an image forming apparatus employing a method of changing control information for forming an image depending on the information of the recording medium to be used, the information being input by user's input, so as to fix an appropriate image onto the recording medium based on the recording medium.

Further, Japanese Laid-open Patent Publication No. 2006-195422 discloses an image forming apparatus employing a method of changing a fixing condition by using recording medium information including surface characteristics, thickness, water content and the like so as to fix an image onto various types of recording media under appropriate fixing conditions.

SUMMARY OF THE INVENTION

According to an aspect of the present invention, there is provided a temperature control method of calculating a temperature of a recording medium after fixing and used in a thermal fixing device. The temperature control method includes separating calculations of calculating the temperature of the recording medium after fixing into first-stage calculations to be performed before start of printing and second-stage calculations to be performed in real time during the printing; performing the first-stage calculations; and performing the second-stage calculations to calculate a result of the temperature of the recording medium after fixing. Further, the result of the temperature of the recording medium after fixing is used to control obtaining a desired temperature of the recording medium after fixing, and the temperature of the recording medium after fixing is calculated without directly measuring the temperature of the recording medium after fixing.

BRIEF DESCRIPTION OF THE DRAWINGS

Other objects, features, and advantages of the present invention will become more apparent from the following description when read in conjunction with the accompanying drawings, in which:

FIG. 8A is a drawing illustrating a method of calculating the temperature vector X according to an embodiment;

FIG. 8B is a drawing illustrating a method of calculating the temperature vector X according to an embodiment;

DETAILED DESCRIPTION OF THE PREFERRED EMBODIMENTS

Figure 1:
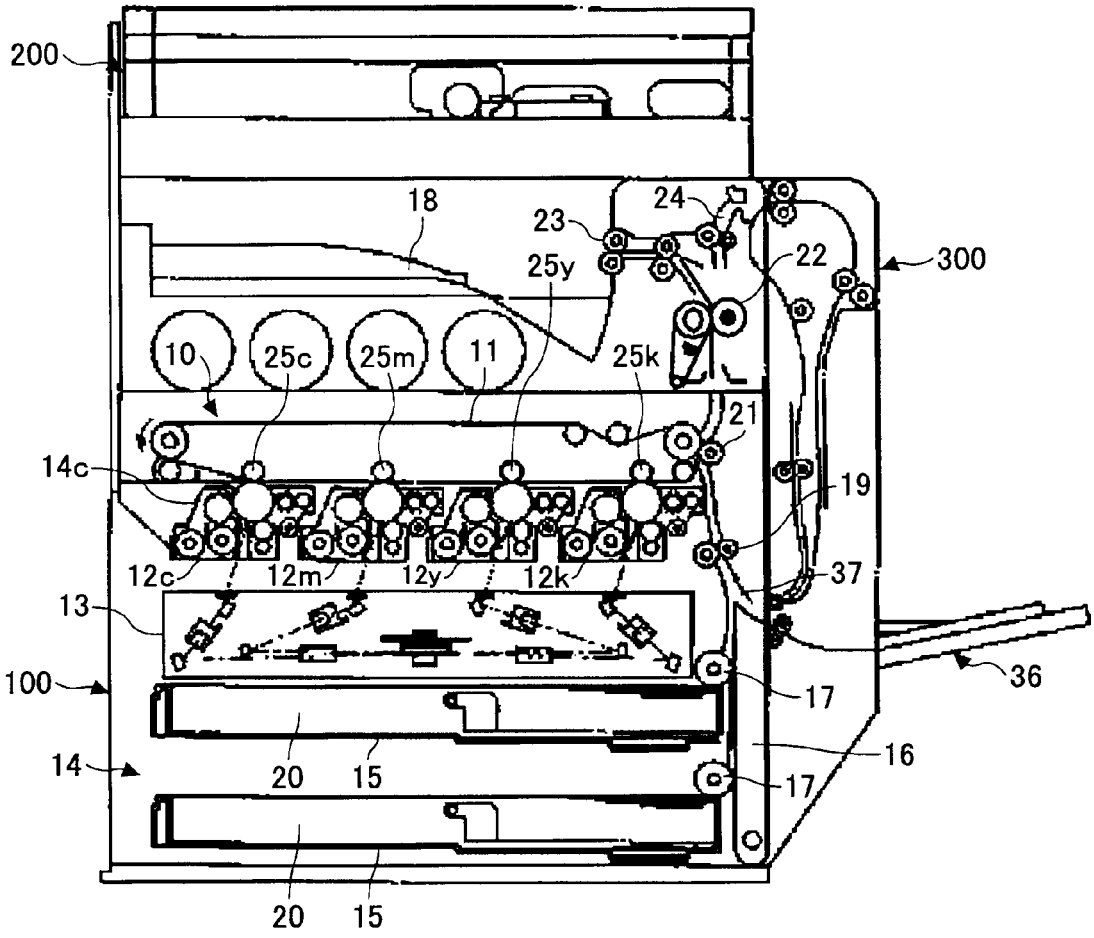
FIG. 1 is a drawing illustrating an entire schematic configuration of an internal mechanism of an image forming apparatus including a fixing device according to an embodiment of the present invention.

In methods of related art cases, for example, Japanese Laid-open Patent Application Nos. 08-137341 and 2006-195422, when the fixing temperature is optimally controlled based on the information of the recording medium, it may be necessary to determine the setting temperature of the fixing member and the like so as to maintain the fixing quality at a constant level based on the characteristic values of the recording medium such as the thickness, the density, the heat transfer rate (thermal conductivity), the specific heat, and the water content rate of the recording medium; and the temperature of the fixing member and the temperature of the pressing member.

In this case, however, as described above, there are a large number of factors which may influence the fixing quality. If tables including all of those factors are generated, a larger number of tables (or a table having a larger amount of data) may become necessary.

Specifically, the temperature of the fixing member and the temperature of the recording medium before fixing are factors that may greatly influence the temperature of the recording medium after fixing (after-fixing recording medium). Therefore, those temperatures may have to be set in detail in the table.

This is why a size (scale) of the table is increased. Therefore, the method using such a table may not be practically used because of, for example, a workload of generating the table and necessity of using a large amount of memory capacity.

Further, it may also be difficult to maintain the fixing quality by calculating the thermal phenomenon between the recording medium and the fixing member by numerical calculation such as the difference method by using the factors which may influence the fixing quality.

This is because, when, for example, the temperature of the fixing member is controlled to have a desired temperature to maintain the fixing quality at a constant level, it may become necessary for a controller to obtain (calculate) the temperature of the recording medium after fixing in real time, set the calculated temperature as the target control temperature, and control the heat source of the fixing member based on the detected temperature of the fixing member and the temperature information of the pressing member.

However, practically, when such a numerical calculation method such as the difference method is used, it may be difficult to calculate in real time due to a large number of calculations required to obtain the temperature of the recording medium after fixing.

Therefore, in an embodiment of the present invention, the algorithm of the difference method to calculate the temperature of the recording medium after fixing is improved, and based on the calculated temperature of the recording medium after fixing, a desired temperature of the recording medium after fixing is realized (obtained). By doing this, the fixing quality may be maintained at a constant level.

In the following, embodiments of the present invention are described with reference to the accompanying drawings.

FIG. 1 illustrates an entire schematic configuration of an internal mechanism in an image forming apparatus including a fixing device according to an embodiment.

The image forming apparatus employs an electrophotographic method, and includes an image forming apparatus main body 100, an image reading apparatus 200 disposed on the image forming apparatus main body 100, and a double-sided unit 300 disposed (attached) on the right side of the image forming apparatus main body 100.

The image forming apparatus main body 100 includes an intermediate transfer device 10. The intermediate transfer device 10 includes an endless intermediate transfer belt 11 substantially horizontally stretched between plural rollers and rotates (travels) in the counterclockwise direction.

Under the intermediate transfer device 10, there are a cyan image forming device 12*c*, a magenta image forming device 12*m*, a yellow image forming device 12*y*, and a black image forming device 12*k*, which are arranged along the traveling direction of the intermediate transfer belt 11 as four-tandem image forming devices.

Those image forming devices 12*c*, 12*m*, 12*y*, and 12*k* include respective charging devices, development devices, transfer devices, cleaning devices and the like. Under the image forming devices 12*c*, 12*m*, 12*y*, and 12*k*, there is an exposure device 13.

Under the exposure device 13, there is provided a sheet feeding device 14. In this example of FIG. 1, the sheet feeding device 14 includes two layers of sheet feeding cassettes 15 containing recording media 20.

Further, on the upper right side of the sheet feeding cassettes 15, there are corresponding sheet feeding rollers 17, which take the recording media 20 one by one and enter them into a recording media feeding path 16.

The recording media feeding path 16 is provided on the right side in the image forming apparatus main body 100, extends from the lower side to the upper side (i.e., in the vertical direction), and is connected to an in-body sheet discharge section 18. Along the recording media feeding path 16, there are feeding rollers 19, a secondary transfer device 21 facing the intermediate transfer belt 11, a fixing device 22, a sheet discharge device 23 including a pair of rollers and the like, which are sequentially arranged.

On the upstream side of the feeding rollers 19, there is provided a sheet feeding path 37 through which the recording medium 20 returned from the double-sided unit 300 or the recording medium 20 transferred from a manual sheet feeding device 36 via the double-sided unit 300 is transferred (guided) to the recording media feeding path 16.

Further, on the downstream side of the fixing device, there is a sheet refeeding path 24 for branching and feeding (guiding) the recording medium 20 to the double-sided unit 300.

To copy an image, the image reading apparatus 200 reads a draft image, the exposure device 13 writes (exposes) the draft image to form respective toner color images onto image carriers of the image forming devices 12*c*, 12*m*, 12*y*, and 12*k*.

Then, the formed toner color images are sequentially transferred onto the intermediate transfer belt 11 by using primary transfer devices 25*c*, 25*m*, 25*y*, and 25*k*, so that a (combined) color image is formed on the intermediate transfer belt 11.

On the other hand, one of the sheet feeding rollers 17 is selectively rotated, so that the recording medium 20 is picked up from the corresponding sheet feeding cassette 15 and is entered into the recording media feeding path 16 or the recording medium 20 manually set on the manual sheet feeding device 36 is fed from the manual sheet feeding device 36 to the sheet feeding path 37.

Then, the recording medium 20 is fed through the recording media feeding path 16 and is further fed to a secondary transfer position by the feeding rollers 19 at a synchronized timing so that the secondary transfer device 21 transfers the (combined) color image formed on the intermediate transfer belt 11 as described above onto the recording medium 20.

The recording medium 20 on which the color image is formed is fed to the fixing device 22, where the color image is fixed to the recording medium 20. Then the recording medium 20 is discharged by the sheet discharge device 23 and stacked on the in-body sheet discharge section 18.

When another image is required to be formed on the rear surface of the recording medium 20, the recording medium 20 is fed (entered) into the sheet refeeding path 24 and reversed in the double-sided unit 300. Then, the recording medium 20 is fed through the sheet feeding path 37 to be re-fed, so that a color image separately formed on the intermediate transfer belt 11 is secondarily transferred onto the (reversed) surface of the recording medium 20 and fixed by the fixing device 22. Then the recording medium 20 is discharged by the sheet discharge device 23 to the in-body sheet discharge section 18.

Figure 2:
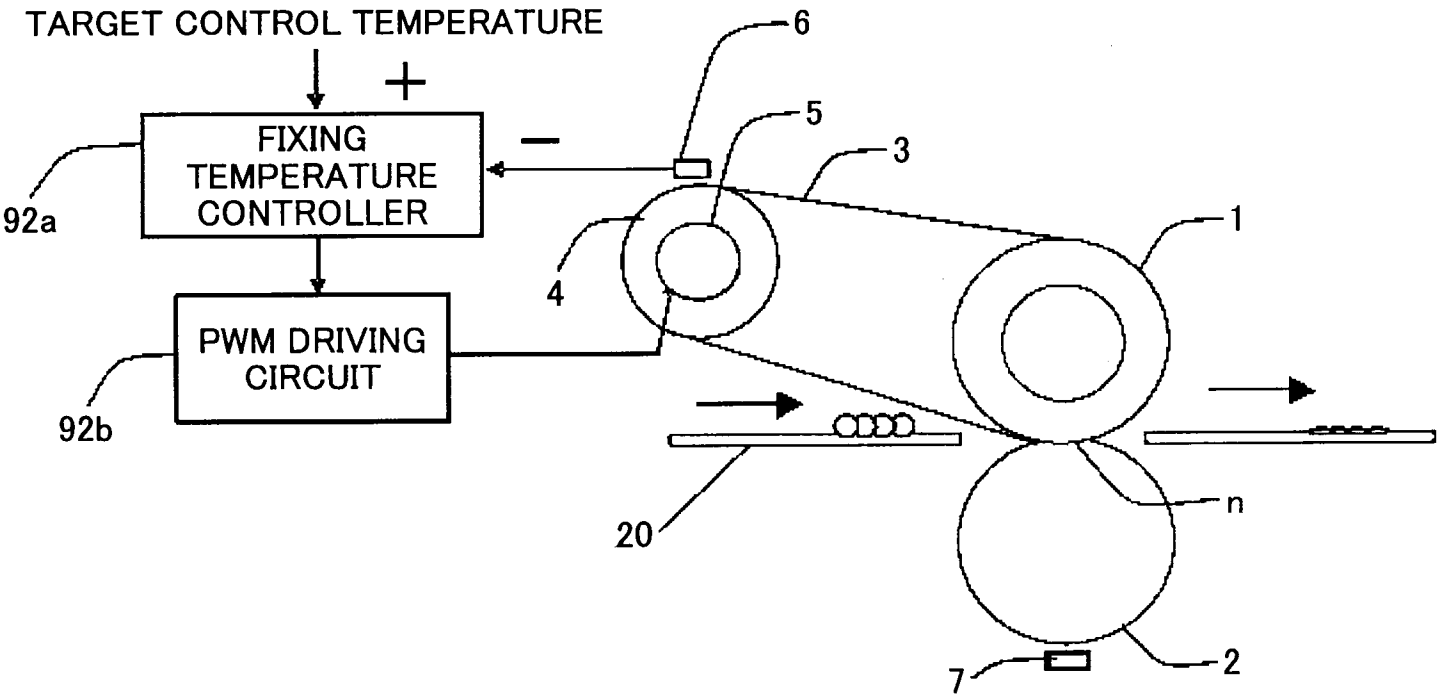
FIG. 2 is a drawing illustrating a schematic configuration of the fixing device according to an embodiment.

FIG. 2 illustrates a schematic configuration of the fixing device 22 according to an embodiment. As illustrated in FIG. 2, the fixing device 22 includes a fixing member (fixing roller) 1 having a roller shape, a pressing member (pressing roller) 2 having a roller shape, a heating roller 4 including a heat source, and a fixing belt 3 stretched between the fixing member 1 and the heating roller 4.

A rotational axis of a first roller selected from the fixing member 1 and the pressing member 2 is (positionally) fixed. The rotational axis of a second roller that is one of the fixing member 1 and the pressing member 2 and that is other than the first roller is movably provided. Further, the second roller is attachable to and detachable from the first roller, and the second roller is biased to the first roller, so that a fixing nip section "n" is formed between the fixing member 1 and the pressing member 2 via the fixing belt 3 sandwiched between the fixing member 1 and the pressing member 2.

In this example, there is no heat source provided in the pressing member 2, and a sponge roller having low heat capacity is used as the pressing member 2. Further, a temperature sensor 7 is provided on the pressing member 2 to monitor the temperature of the pressing member 2.

Next, the heat source is described.

A halogen heater 5 is disposed in the heating roller 4 so as to heat the fixing belt 3. Here is a case where the halogen heater 5 is used. However, the present invention is not limited to this configuration. For example, as the heat source to heat the fixing belt 3, any other appropriate heat source such as a ceramic heater, an Induction Heater (IH) or the like may be used.

Next, a temperature control method of controlling a temperature of the fixing device 22 is described.

In the fixing device 22 of FIG. 2, a non-contact type temperature sensor 6 is provided near the fixing belt 3 to measure a temperature of the fixing belt 3. Further, the fixing device 22 includes a fixing temperature controller 92*a* that changes a power value to be applied to the halogen heater 5 via a PWM driving circuit 92*b* by controlling a power supplying time in a unit time period (i.e., DUTY) based on information indicating a temperature deviation between a designated target control temperature of the fixing belt 3 and a detected temperature of the fixing belt 3, the temperature being detected by the non-contact type temperature sensor 6.

By having the configuration described above, the power applied to the halogen heater 5 is controlled so that the heat (heat capacity) applied to the recording medium 20 and the toner passing through the fixing nip section "n" is in a predetermined state (level, value).

Figure 3:
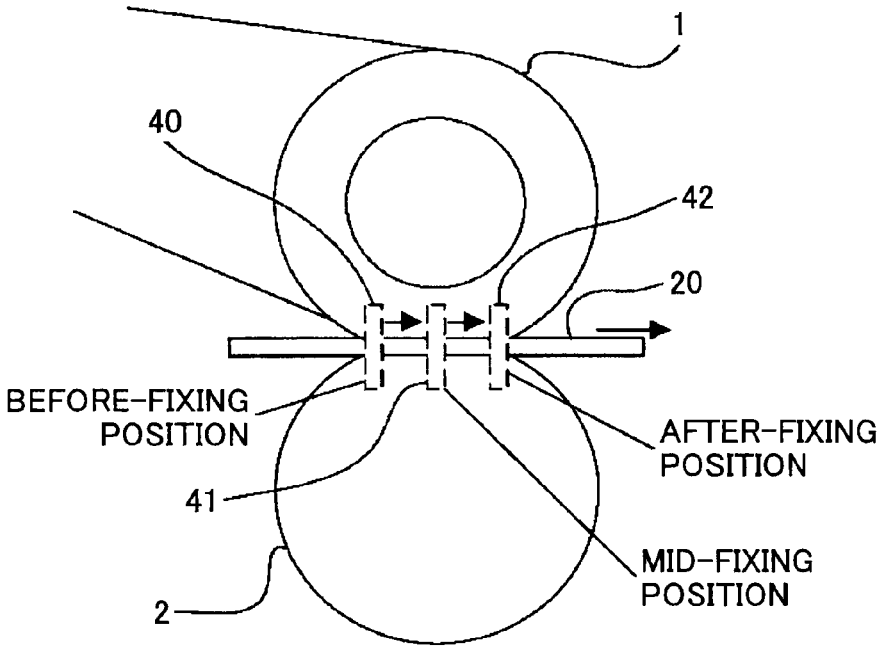
FIG. 3 is a drawing for illustrating a calculation method of calculating a temperature of a recording medium after fixing according to an embodiment.

FIG. 3 illustrates a calculation method of calculating the temperature of the recording medium 20 after fixing according to an embodiment. This calculation is to calculate (obtain) a temperature transition of the temperature distribution in the regions 40, 41, and 42 illustrated in dotted lines in FIG. 3.

Figure 4:
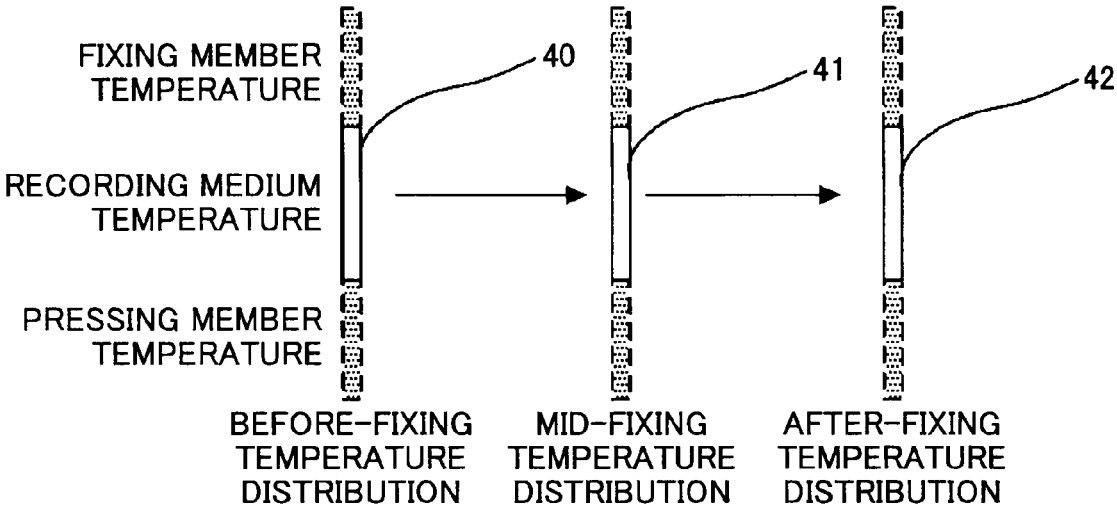
FIG. 4 illustrates transition of a temperature of a recording medium and calculation of the temperature of the recording medium after fixing according to an embodiment.

FIG. 4 is a conceptual drawing illustrating the temperature transition of a temperature of the recording medium 20 and calculation of the temperature of the recording medium 20 after fixing according to an embodiment. According to an embodiment, first, the temperature distribution in the fixing member 1, the recording medium 20, and the pressing member 2 in the region 40 is used as an initial value.

Based on this initial value, a heat amount of the temperature distribution in the region 41 during the fixing is calculated, and the heat amount of the temperature distribution in the region 42 disposed at the end of the fixing nip section after the fixing is further calculated. Here, it is assumed that the heat amount during the fixing is calculated based on the calculation of the heat (thermal) transfer between the members using a heat transfer equation.

Next, a heat amount calculation during fixing and a heat transfer model to calculate the temperature of the recording medium after fixing according to an embodiment are described.

Figure 5A:
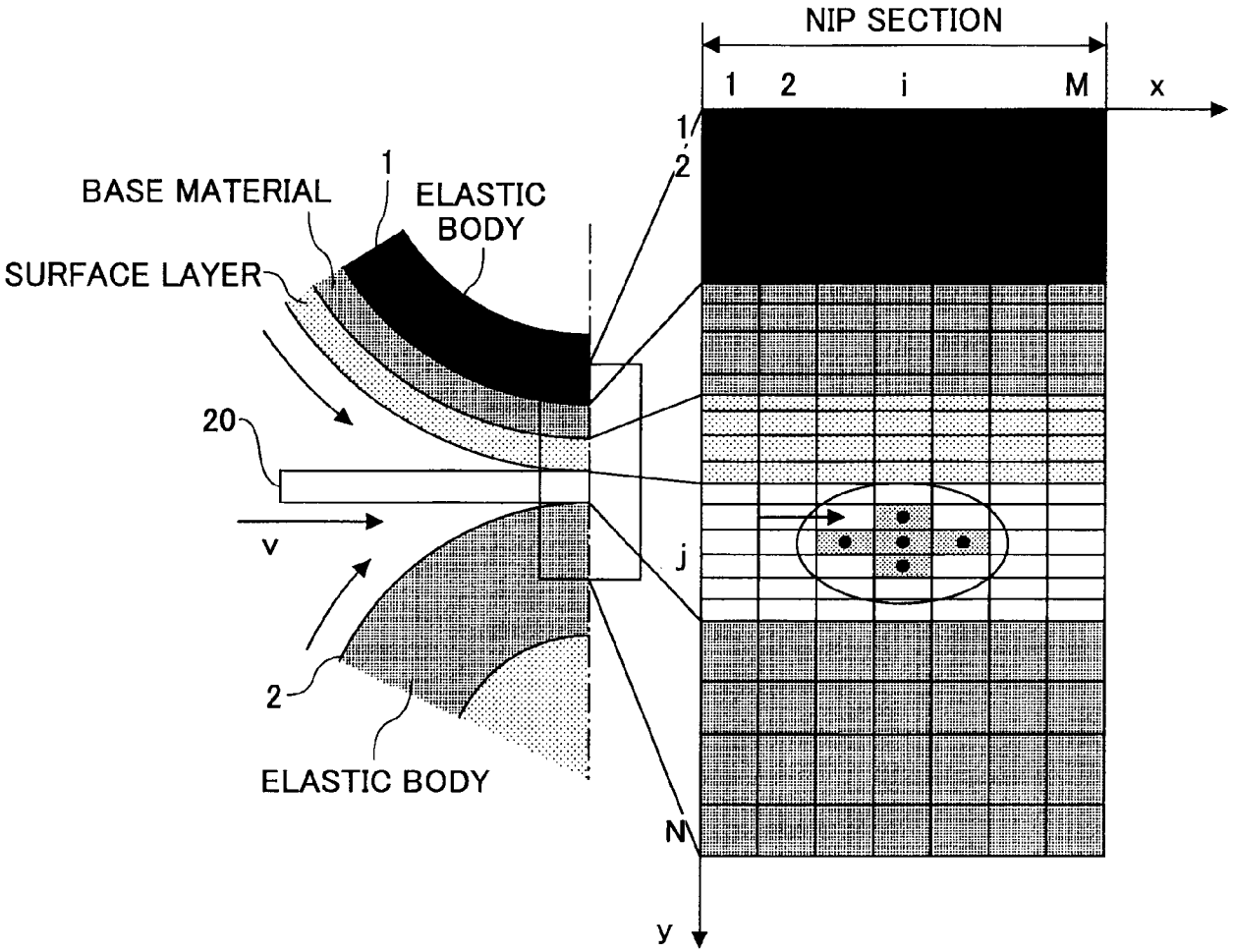
FIG. 5A is a drawing illustrating a heat (thermal) transfer model of a fixing nip section corresponding to regions 40, 41, and 42 in temperature distributions of FIGS. 3 and 4.

FIG. 5A illustrates the heat transfer model of the fixing nip section "n" of the temperature distributions in the regions 40, 41, and 42 illustrated in FIGS. 3 and 4. More specifically, in this heat transfer model of FIG. 5A, the temperature distribution in the region defined by the rectangular in the drawing on the left-hand side is enlarged in the drawing on the right-hand side.

The rectangular region includes a part of the fixing member 1, the recording medium 20, and the pressing member 2. Further, the rectangular region in the drawing on the left-hand side is divided into plural discrete points in the drawing on the right-hand side.

Here, the x direction denotes the moving (feeding) direction of the recording medium 20, and the y direction denotes the thickness direction of the members (i.e., the fixing belt 3, the fixing member 1, the recording medium 20, and the pressing member 2) constituting the fixing nip section "n".

As illustrated in the drawing on the right-hand side, the position (x,y) of an arbitrary discrete point in the fixing nip section "n" is given by coordinate values (i,j). Here, the symbol "i (i=1, 2, . . . , M)" denotes a spatial position in the x direction, and the symbol "j (j=1, 2, . . . , N)" denotes a spatial position in the y direction".

In the fixing nip section "n", there is a non-stationary (unsteady) heat transfer field having a larger temperature inclination along the y direction. On the other hand, along the x direction, there is heat transfer due to the movement of the recording medium 20 and the rotation of the fixing belt 3, the fixing member 1, and the pressing member 2.

The heat transfer occurs from the fixing member 1 having a higher temperature to the recording medium 20 having a lower temperature. The heat transfer in the fixing nip section "n" may be given by a two-dimensional non-stationary heat transfer equation, and a temperature "A" may be acquired by a numerical analysis using a difference method where the following formula (1) is used as a fundamental formula.

$$\rho c\frac{\partial\theta}{\partial t} = \frac{\partial}{\partial x}\left(\lambda\frac{\partial\theta}{\partial x}\right) + \frac{\partial}{\partial y}\left(\lambda\frac{\partial\theta}{\partial y}\right) \tag{1}$$

Here, the symbols "θ", "ρ", "c", "λ", and "t" denote a temperature, a density, a specific heat, a heat transfer rate (thermal conductivity), and time (time step number).

Further, the formula (1) may be expressed in a difference approximation formula of the following formula (2)

$$\frac{\rho c}{\Delta t}(\theta_{i,j}(t+1) - \theta_{i,j}(t)) = \frac{\lambda}{(\Delta x)^2}(\theta_{i+1,j}(t) - \theta_{i,j}(t)) + \frac{\lambda}{(\Delta x)^2}(\theta_{i-1,j}(t) - \theta_{i,j}(t)) + \tag{2}$$

-continued $$\frac{\lambda}{(\Delta y)^2}(\theta_{i,j+1}(t)-\theta_{i,j}(t))+\frac{\lambda}{(\Delta y)^2}(\theta_{i,j-1}(t)-\theta_{i,j}(t))$$

Here, the temperature θ(t+1) at the grid point (i,j) at time "t+1" may be given by the following formula (3). In formula (3), the symbols "$B_o$", "$B_u$", "$B_d$", "$B_r$", and "$B_l$" are (scalar) coefficients described in formulas (4) to (6).

$$\theta_{i,j}(t+1)=B_o\theta_{i,j}(t)+B_u\theta_{i,j+1}(t)+B_d\theta_{i,j-1}(t)+B_r\theta_{i+1,j}(t)+B_l\theta_{i-1,j}(t) \quad (3)$$

$$B_u=B_d=\frac{\lambda\Delta t}{\rho c(\Delta y)^2} \quad (4)$$

$$B_r=B_l=\frac{\lambda\Delta t}{\rho c(\Delta x)^2} \quad (5)$$

$$B_o=1-B_u-B_d-B_r-B_l \quad (6)$$

Further, when the heat transfer in the sheet feeding direction (x direction) is neglectable when compared with the heat transfer in the thickness direction of the members (y direction), the formula (3) may be expressed in formula (7).

The formula (7) is obtained by discretizing the heat transfer equation, and illustrates the temperature of the grid point (i,j) at time "t+1", the temperature being expressed by using the temperatures in the grid points (i,j−1), (i,j), and (i, j+1) at time "t".

The time "t+1" herein denotes time when one time step has passed since time "t". Herein, the term discretizing (discretization) refers to a process of replacing the temperature information continuously defined in formula (1) by the temperature information of the points discontinuously arranged in the fixing nip section "n" as illustrated in FIG. 5A.

$$\theta_{i,j}(t+1)=B_o\theta_{i,j}(t)+B_u\theta_{i,j+1}(t)+B_d\theta_{i,j-1}(t) \quad (7)$$

Figure 5B:
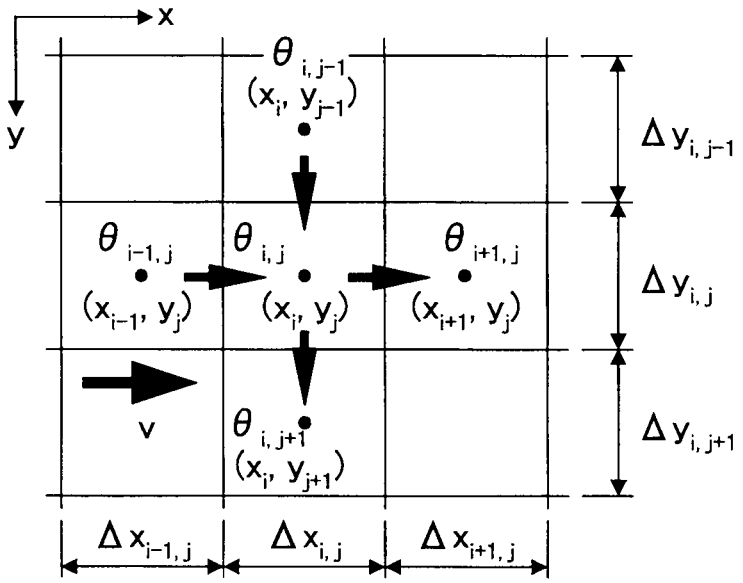
FIG. 5B is an enlarged view of a part of the recording medium in the heat transfer model of FIG. 5A.

FIG. 5B is an enlarged view of a part of the recording medium 20 in the heat transfer model of FIG. 5A. More specifically, FIG. 5B illustrates the heat transfer in the thickness direction (y direction) of the members in the discrete point in the fixing nip section "n". Here, an arbitrary discrete point (i,j) has a temperature $\theta_{i,j}(t)$ at time "t".

Similarly, the discrete points (i,j−1), (i,j+1), (i−1,j), and (i+1,j) have temperatures $\theta_{i,j-1}(t)$, $\theta_{i,j+1}(t)$, $\theta_{i-1,j}(t)$, and $\theta_{i+1,j}(t)$, respectively. The discrete points (i,j−1), (i,j+1), (i−1,j), and (i+1,j) are located upper, lower, left, and right, respectively, adjacent to the discrete point (i,j) as illustrated in FIG. 5B.

Here, it is assumed that the recording medium 20 is fed in the x direction at a velocity "v". The arrows in FIG. 5B denote flows of heat. Specifically, heat from the fixing member 1 transfers to the recording medium 20 in the y direction from the discrete point (i,j−1) to the discrete point (i,j) and from the discrete point (i,j) to the discrete point (i,j+1).

In this case, heat also transfers in the x direction from the discrete point (i−1,j) to the discrete point (i,j) and from the discrete point (i,j) to the discrete point (i,j+1). However, as described above, (the amount of) the heat transferred in the x direction may be neglected when compared with (the amount of) the heat transferred in the y direction.

Figure 6A:
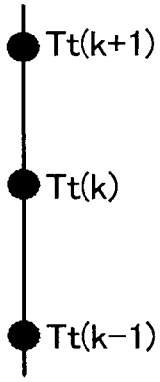
FIG. 6A is a drawing illustrating a formula of calculating the temperature of the recording medium after fixing according to an embodiment.

FIG. 6A illustrates a formula to calculate the temperature of the recording medium 20 after fixing according to an embodiment.

The heat amount during the fixing is calculated based on the heat transfer equation expressing the heat transfer between the members. When the heat transfer equation is discretized, the following formula (8) is acquired. As expressed in formula (8), a temperature at time "t+1" after one time step has passed since time "t" may be calculated based on the temperatures at time "t".

$$T_{t+1}(k)=B_O\cdot T_t(k)+B_U\cdot T_t(k+1)+B_D\cdot T_t(k-1) \quad (8)$$

Here, symbols "t" and "k" are suffixes representing time step number and spatial position, respectively.

Further, the symbols "$B_O$", "$B_U$", and "$B_D$" are coefficients used in the calculations and calculated based on the thickness, the density, the heat transfer rate (thermal conductivity), and the specific heat of the recording medium 20.

Figure 6B:
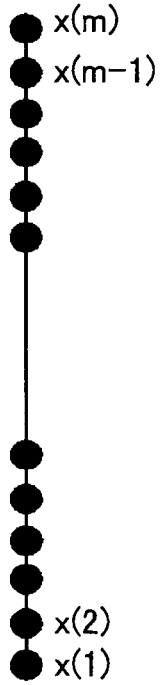
FIG. 6B is a drawing illustrating a temperature vector X according to an embodiment.

FIG. 6B illustrates a temperature vector X according to an embodiment. As described above, the heat transfer in the x direction may be neglected when compared with the heat transfer in the y direction because the heat transfer in the x direction is sufficiently smaller than that in the y direction. Therefore, the discrete point (i,j) in the heat transfer model in the fixing nip section "n" of FIG. 5A may be simplified as the discrete points (1, 2, . . . , m−1, m).

FIG. 6B schematically illustrates the temperature vector X of the discrete points in this case. Herein, the temperature vector X refers to temperature information (data) at the corresponding discrete point of the heat transfer model (determined) in the regions of the fixing member 1, the recording medium 20, and the pressing member 2 in the fixing nip section "n".

The temperature distribution in the fixing member 1, the recording medium 20, and the pressing member 2 may be expressed by the temperature vector X={X(1), X(2), . . . , X(m)} by allocating the temperature values of the discrete points in the members in formula (7) to "m" elements (cells); namely, those values of the elements transmitted based on the calculation of the heat transfer.

In other words, each of the regions of the fixing member 1, the recording medium 20, and the pressing member 2 is separated into "m" elements (cells). Then, the discrete points are determined with respect to the elements, and formula 7 is applied to the discrete points.

The figures in the temperature vector X denote the corresponding discrete points. Namely, for example, "X(1)" denotes the temperature of the discrete point (1), "X(2)" denotes the temperature of the discrete point (2), and "X(m)" denotes the temperature of the discrete point (m).

Figure 7:
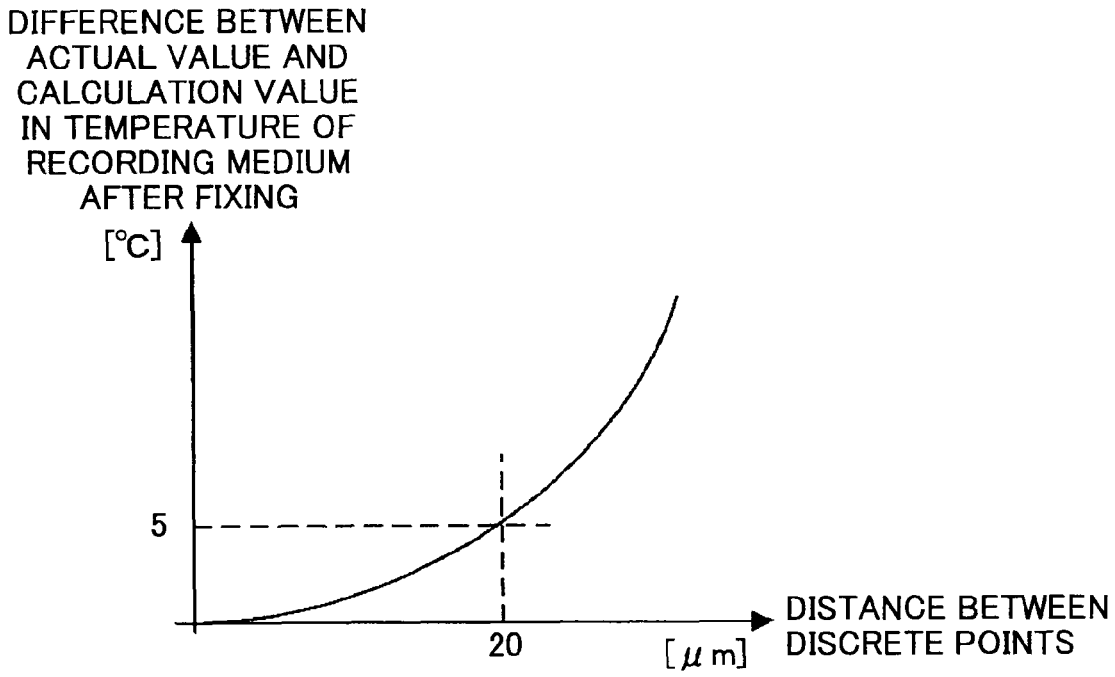
FIG. 7 is a drawing illustrating a distance between the discrete points existing in the fixing nip section (a fixing member, the recording medium, and a pressing member) and the borders thereof.

FIG. 7 illustrates a distance between the discrete points existing in the fixing nip section "n" (the fixing member 1, the recording medium 20, and the pressing member 2) and the borders thereof.

To calculate accurately, it is preferable that the distance between the discrete points is in a range from approximately 10 μm to approximately 30 μm. When the distance between the discrete points is less than or equal to 10 μm, the number of the discrete points may be too many and it may take a long time to complete repeated calculations.

On the other hand, when the distance between the discrete points is greater than or equal to 30 μm, the obtained calculation result may be too coarse due to an insufficient number of the discrete points. Further, specifically, to maintain good (sufficient) fixing quality (e.g., fixing characteristics and a degree of gloss (luster)), it is preferable that the difference between that actual measured value and the calculation value of the temperature of the recording medium after fixing is less than or equal to 5° C. (degrees).

To obtain the difference less than or equal to 5° C., it is preferable that the distance between the discrete points is less than or equal to 20 μm. Further, here, the calculation regions of the members are determined so that the calculation region of the fixing member 1 is approximately 300 μm from the surface layer thereof, the thickness of the recording medium 20 is in a range approximately from 100 μm to 300 μm, and the calculation region of the pressing member 2 is approximately 300 μm from the surface (layer) thereof. In the case, the number of the discrete points in the fixing nip section "n" is approximately 50.

Next, with respect to the temperature vector X, the initial temperature vector in the region 40 as an initial condition before fixing is given as the temperature vector $X_0$. On the other hand, the temperature vector X in the region 42 in a state where the fixing is finished (after fixing) is given as the temperature vector $X_{end}$.

In the fixing control according to an embodiment, the temperature vector $X_{end}$ of the discrete points at the exit (end) part of the fixing nip section "n" are calculated in real time so that the temperature of the recording medium 20 after fixing is controlled at a predetermined temperature (within a predetermined range). Then, the temperature vector $X_{end}$ is set as the target control temperature.

Then, based on the target control temperature, a detected temperature of the fixing belt 3, and temperature information of the pressing member 2, the fixing temperature controller 92*a* turns ON and OFF the halogen heater 5 and controls the power supply time period to the halogen heater 5 so as to control the temperature of the fixing belt 3 at the entrance of the fixing nip section "n".

In this case, however, it may not always be necessary to calculate the temperature vector $X_{end}$ in real time for each of the recording media 20. For example, the temperature vector $X_{end}$ may be calculated based on the control cycle of the fixing temperature controller 92*a*.

FIG. 8A illustrates a method of calculating the temperature vector X according to an embodiment.

As illustrated in FIG. 8A, formula (8) may be expressed as a matrix A. In this embodiment, by using the matrix A, the temperature vector $X_{end}$ corresponding to a state after fixing may be acquired. Namely, the matrix A is accumulated (repeatedly applied) to the X (temperature vector X). Here, to accumulate the matrix A is equivalent to calculating the heat transfer between the elements of X based on a finite difference method (FDM).

FIG. 8B also illustrates a method of calculating the temperature vector X according to an embodiment. When the heat transfer in the sheet feeding direction (x direction) is relatively small and neglectable, formula (7) may be expressed in formula (9) Here, the matrix $A_t$ is expressed as formula (10).

$$\theta(t+1)=A_t\theta(t) \tag{9}$$

where, the matrix $A_t$ is expressed in formula (10).

$$A_t=\begin{bmatrix} B_o & B_u & & & & \\ B_d & B_o & B_u & & 0 & \\ & B_d & B_o & & & \\ & & & \ddots & & \\ & & & B_o & B_u & \\ & 0 & & B_d & B_o & B_u \\ & & & & B_d & B_o \end{bmatrix} \tag{10}$$

As illustrated in FIG. 8B, by using the matrix A, the formula (9) may be expressed as $X_{t+1}=A_t \cdot X_t$. In this embodiment, by using the matrix $A_t$, the temperature vector $X_{end}$ (i.e., the temperatures at the exit (end) part of the fixing nip section "n") corresponding to the region 42 after fixing may be obtained (calculated).

Specifically, the temperature information $X_0$ (i.e., temperature vector $X_0$) at the entrance (start) part of the fixing nip section "n" of the members is used as initial conditions, and the change (transition) of the heat transfer in the fixing nip section "n" with time is repeatedly calculated, so that the temperature vector $X_{end}$ at the exit (end) part of the fixing nip section "n" is estimated and calculated.

Namely, to that end, the matrix A is accumulated (repeatedly applied) to the X (temperature vector X). Here, as described above, to accumulate (repeatedly multiply) the matrix A with the temperature vector X is equivalent to calculating the heat transfer between the elements of X based on the finite difference method (FDM).

Figure 9:
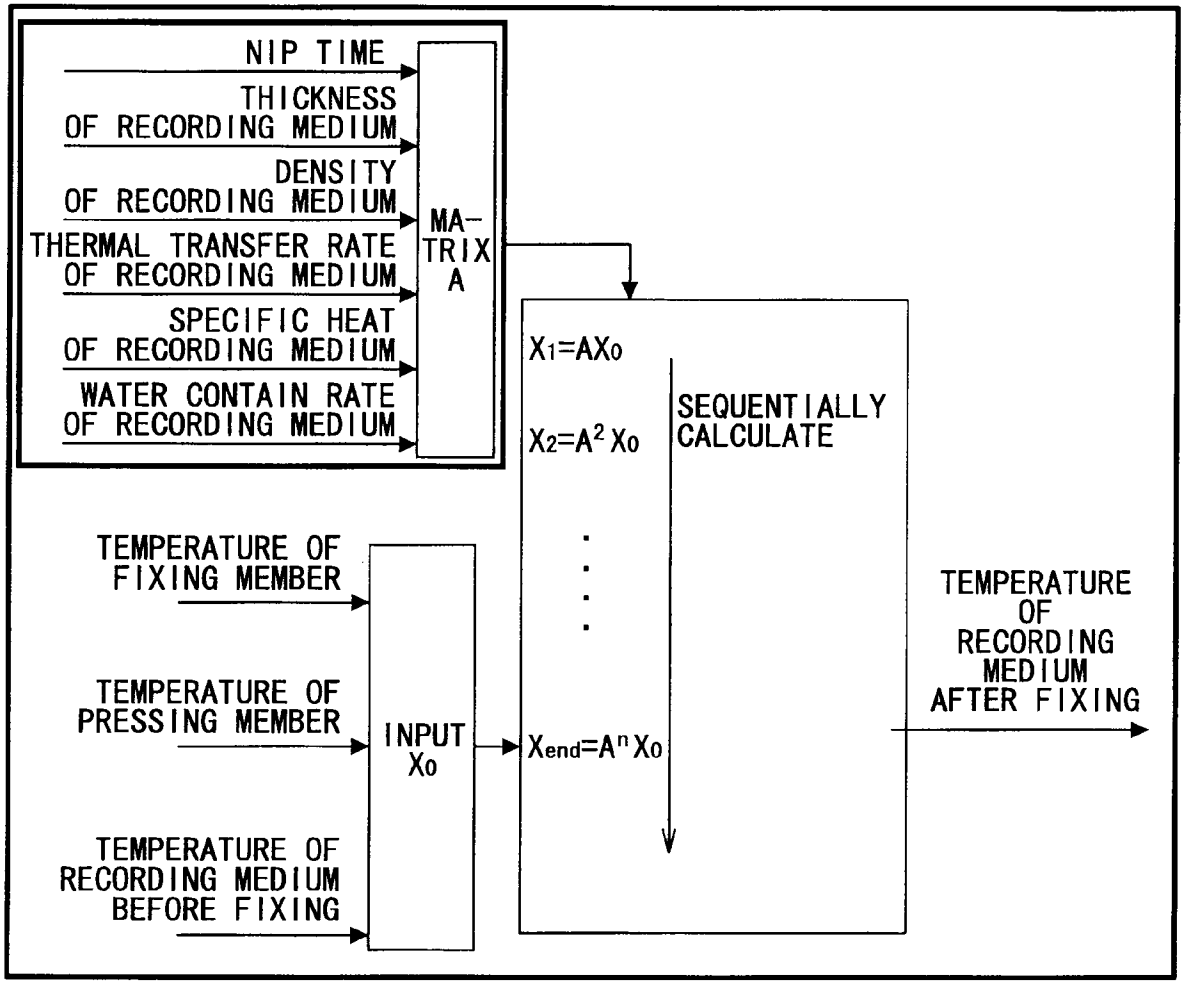
FIG. 9 is a drawing illustrating a method of calculating the temperature vector X according to an embodiment.

FIG. 9 illustrates a method of calculating the temperature vector X according to the embodiment.

As described above, by accumulating (repeatedly multiplying) the matrix A with the temperature vector X, the heat transfer in the fixing nip section "n" may be calculated. As the initial temperature vector $X_0$, at least one of the temperature values of the fixing belt 3 and the pressing member 2 at the entrance (start) part of the fixing nip section "n" and the temperature of the recording medium 20 before fixing is used.

Further, as the matrix A, at least one of a nip time, the thickness of the recording medium, the density of the recording medium, the heat transfer rate (thermal conductivity) of the recording medium, the specific heat of the recording medium, and the water content rate of the recording medium is used.

Here, $X_{t+1}=A_t \cdot X_t$, therefore:

$$X_1=A_0 \cdot X_0$$

$$X_2=A_1 \cdot X_1=A_1 \cdot A_0 \cdot X_0$$

$$\ldots$$

$$X_n=X_{end}=A_n \cdot A_{n-1} \cdot \ldots A_1 \cdot A_0 \cdot X_0$$

Therefore, by multiplying the matrix A "n" times and further multiplying the result by $X_o$, the temperature vector $X_{end}$ after fixing is obtained. Here, the symbol "n" refers to the number of the discrete points and depends on the width of the fixing nip section "n".

However, in this method, the number "n" of repeatedly multiplying the matrix A to obtain the temperature vector $X_{end}$ based on the temperature vector $X_o$ is typically extremely large to be approximately 600. This is because, in order to stably calculate when assuming that the distance of the discrete points is in a range from 10 μm to 30 μm, it may be required to set the sampling time of the calculations (i.e. time period between adjacent accumulation calculations) to approximately 0.1 ms.

Therefore, when assuming that the nip time is, for example, 60 ms, the number "n" is 600. However, it is thought that such a large amount of the calculations may not be executed by the fixing temperature controller 92*a* alone. Therefore, it may not be possible to directly use this method for the above control. As the fixing temperature controller 92*a*, a feedback controller, a feed-forward controller and the like may be used.

Figure 10:
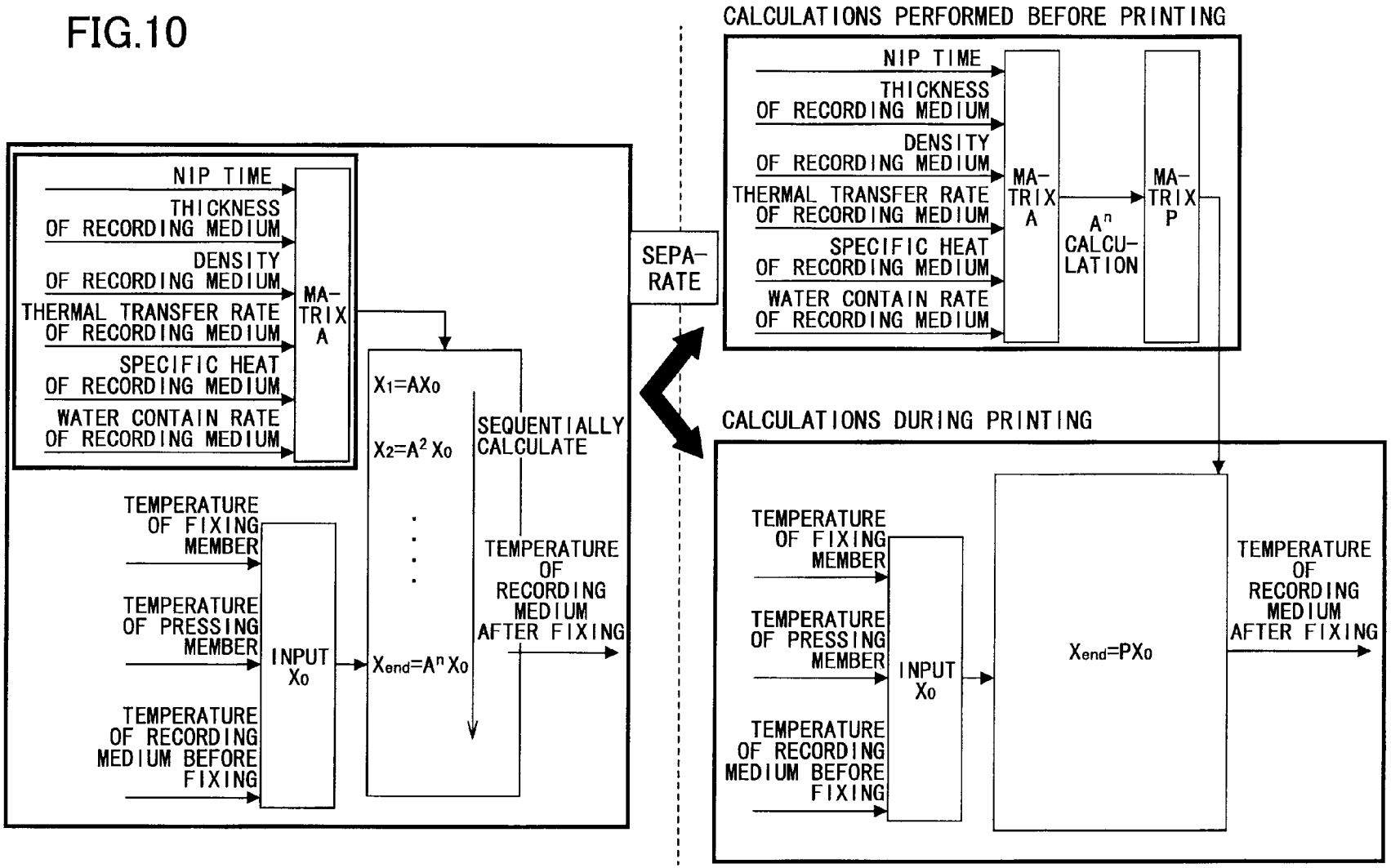
FIG. 10 is a drawing illustrating a method of accelerating the calculation according to an embodiment.

FIG. 10 illustrates a method of accelerating the calculation according to an embodiment.

It is thought that the thickness, the heat transfer rate (thermal conductivity), the specific heat, the density and the like of the members from the entrance (start) part to the exit (end) part of the fixing nip section "n" are not changed.

Therefore, in the region where the calculations according to the embodiment are to be performed, the matrix A for each calculation timing may not be changed. Therefore, the matrix A in an arbitrary discrete point in the fixing nip section "n" may be obtained as $A_1=A_2=\ldots=A_t=A$.

Here, $X_{t+1}=A\cdot X_t$, therefore:

$$X_1=A\cdot X_0$$

$$X_2=A\cdot X_1=A\cdot A\cdot X_0=A^2\cdot X_0$$

$$\ldots$$

$$X_n=X_{end}=A\cdot A\cdot\ldots\cdot A\cdot X_0=A^n\cdot X_0$$

Therefore, $X_{end}=A^n\cdot X_0$. By using this result, it may become possible to perform the calculation n times in advance before printing (fixing). Namely, the matrix indicating (defined by) $P=A^n$ may be calculated in advance before printing.

Further, during printing, when assuming that the temperature vector $X_0$ is also obtained in advance, it may be necessary to perform only a single calculation $X_{end}=P\cdot X_0$ during the printing to obtain $X_{end}$ which is the temperature vector after fixing.

In this calculation, the number of the calculations of multiplying the matrix is one. Therefore, when compared with the calculation amount when the matrix P is not used, the calculation amount when the matrix P is used may be reduced as low as a several thousandth of that when the matrix P is not used.

Therefore, even when the fixing temperature controller 92*a* is used, the "real-time" calculation may be achieved. Namely, with the fixing temperature controller 92*a*, it may become possible to calculate the temperature vector $X_{end}$ corresponding to the temperatures of the recording medium 20 after fixing in real time with an accuracy equivalent to that when the finite difference method (FDM) is used.

Further, by setting the calculated temperature vector $X_{end}$ corresponding to the temperatures of the recording medium 20 after fixing as the target control temperature, and by, based on the detected temperature of the fixing belt 3 and temperature information of the pressing member 2, turning ON and OFF the halogen heater 5 and controlling the power supply time period of the halogen heater 5 with the fixing temperature controller 92*a*, so as to adjust (control) the temperature of the fixing belt 3 at the entrance of the fixing nip section "n", it may become possible to realize (achieve) the temperature of the recording medium after fixing.

Further, during printing, as long as there is no change of the printing condition which may cause a change of the matrix P, when the temperature vector $X_0$ is obtained, the temperature vector $X_{end}$ may be acquired based on the calculation $X_{end}=P\cdot X_0$. For example, the change in a characteristic value of the thickness, the water content rate or the like of the recording medium 20 may cause the change of the heat transfer state and the printing condition.

As described above, according to an embodiment a temperature control method of calculating a temperature of a recording medium after fixing and used in a thermal fixing device, the temperature control method includes separating calculations of calculating the temperature of the recording medium after fixing into first-stage calculations to be performed before start of printing and second-stage calculations to be performed in real time during the printing; performing the first-stage calculations; and performing the second-stage calculations to calculate a result of the temperature of the recording medium after fixing.

Further, the result of the temperature of the recording medium after fixing is used to control obtaining a desired temperature of the recording medium after fixing, and the temperature of the recording medium after fixing is calculated without directly measuring the temperature of the recording medium after fixing.

By doing this, it may become possible to accurately calculate the temperature of the recording medium after fixing in real time. Further, based on the calculated temperature of the recording medium after fixing, it may become possible to realize (achieve) a desired temperature of the recording medium after fixing. As a result, it may become possible to substantially stabilize the fixing quality.

Further, as an example of the actual control method using the temperature vector $X_{end}$ corresponding to the calculated temperatures of the recording medium after fixing, there may be a method in which the temperature of the fixing member is (directly) changed or the nip time is (directly) changed. On the other hand, in the method according to an embodiment, by at least controlling (using) the temperature of the fixing member having excellent (sufficient) controllability, it may become possible to accurately control the temperature of the recording medium after fixing at a desired temperature.

To that end, as described above, by setting the temperature vector $X_{end}$ as the target control temperatures, and by, based on the target control temperatures, the detected temperature of the fixing belt 3, and the temperature information of the pressing member 2 (roller), controlling the timings of turning ON and OFF the halogen heater 5 and the power supply time period of supplying power to the halogen heater 5, the temperature of the fixing belt 3 at the entrance (start) part of the fixing nip section "n" may be adjusted (controlled).

Further, according to an embodiment, in the calculation to be performed before the printing is started (i.e., in generating the matrix A to generate the matrix P), it may be necessary to have factors (data) of the nip time of the fixing device, the thickness of the recording medium, the density of the recording medium, the heat transfer rate (thermal conductivity) of the recording medium, the specific heat of the recording medium, the water content rate of the recording medium and the like for the temperature of the recording medium after fixing.

In this case, the basis weight (paper weight in gms) of the recording medium, which is proportional to the thickness of the recording medium and the density of the recording medium may be used.

With respect to the factors, the more the number (types) of factors under the practically used conditions becomes, the higher the accuracy of the calculation results becomes.

It is preferable that the values (of the factors) under the practical use are, for example, manually input by a user via a panel input of an image forming apparatus or a computer or input by sensing using sensors.

Therefore, in the calculation before printing is started, by using at least one of the nip time of the fixing device, the basis weight of the recording medium, the heat transfer rate (thermal conductivity) of the recording medium, the specific heat of the recording medium, and the water content rate of the recording medium, it may become possible to accurately control the temperature of the recording medium after fixing.

Further, according to an embodiment, the calculation performed during printing (i.e., the generation of the temperature vector $X_0$) requires the temperature of the fixing member, the temperature of the pressing member, and the temperature of the recording medium before fixing (before-fixing recording medium).

With respect to those factors (data), the more the number of acquired data under practical conditions becomes, the higher the accuracy of the acquired calculation result becomes. As described above, it is preferable that the values (of the factors) under the practical use conditions are, for example, manually input by a user via a panel input of an image forming apparatus or a computer or input by sensing using sensors.

As described above, in the calculations performed during printing, by using at least one of the temperature of the fixing member, the temperature of the pressing member, and the temperature of the recording medium before fixing, it may become possible to accurately control the temperature of the recording medium after fixing.

According to an embodiment, a temperature control method of calculating a temperature of a recording medium after fixing and used in a thermal fixing device, includes separating calculations of calculating the temperature of the recording medium after fixing into first-stage calculations to be performed before start of printing and second-stage calculations to be performed in real time during the printing; performing the first-stage calculations; and performing the second-stage calculations to calculate a result of the temperature of the recording medium after fixing.

Further, the result of the temperature of the recording medium after fixing is used to control obtaining a desired temperature of the recording medium after fixing, and the temperature of the recording medium after fixing is calculated without directly measuring the temperature of the recording medium after fixing.

As described above, according to an embodiment, a temperature control method in a thermal fixing device includes separating the calculations of the temperature of the recording medium after fixing into the calculations to be performed before printing (fixing) and the calculations to be preformed during printing (fixing) and performing control based on the calculated temperature of the recording medium after fixing without directly measuring (sensing) the temperature of the recording medium after fixing.

By doing this, during printing, it may become possible to accurately calculate the temperature of the recording medium after fixing in real time. Then, by using the calculated temperature of the recording medium after fixing, the thermal fixing device may be controlled. Further, during printing, so long as no event that may influence the matrix P has occurred, when $X_0$ is acquired, $X_{end}$ may be calculated based on $X_{end}=P \cdot X_0$.

Further, preferably, at least a temperature of a fixing member may be controlled by using the result of the temperature of the recording medium after fixing.

In an actual control method using the temperature of the recording medium after fixing, there may be a method in which the temperature of the fixing member or the nip time is changed. However, according to an embodiment, by controlling the temperature of the fixing member having excellent controllability, it may become possible to accurately control the temperature of the recording medium after fixing.

Further, preferably, the result of the temperature of the recording medium after fixing may be set as a target control temperature, and at least the temperature of the fixing member may be determined based on a detected temperature of the fixing member and temperature information of a pressing member.

Further, preferably, the temperature of the recording medium after fixing may be calculated by dividing a region of a nip section including a fixing member, the recording medium, and a pressing member provided in the thermal fixing device into plural discrete points, and calculating temperatures of the plural discrete points using difference method calculations.

Further, preferably, in the first-stage calculations, at least one of a nip time of the thermal fixing device, a basis weight of the recording medium, a heat transfer rate of the recording medium, a specific heat of the recording medium, and a water content rate of the recording medium may be used.

Further, in the calculation to be performed before the start of printing, namely in order to generate the matrix A for generating the matrix P, the nip time of the thermal fixing device, the thickness of the recording medium, the density of the recording medium, the heat transfer rate of the recording medium, the specific heat of the recording medium, or the water content rate of the recording medium may be necessarily used.

In those factors, the more the number of the values (data) under conditions similar to the actual conditions becomes, the more accurate the obtained calculation result becomes. Preferably, the values under the actually used conditions are manually input by a user via the panel of the image forming apparatus or a computer or by sensing using a sensor.

Therefore, in the calculations to be performed before printing (fixing), by using at least one of the nip time of the thermal fixing device, the thickness (basis weight) of the recording medium, the heat transfer rate of the recording medium, the specific heat of the recording medium, and the water content rate of the recording medium, it may become possible to highly-accurately control the temperature of the recording medium after fixing.

Further, preferably, in the second-stage calculations, an actual value of at least one of a temperature of a fixing member, a temperature of a pressing member, and a temperature of the recording medium before fixing may be used.

Further, according to an embodiment, in the calculations to be performed during the printing (fixing), namely to generate the thermal vector $X_0$, the data of the temperature of the fixing member, the temperature of the pressing member, and the temperature of the recording medium before fixing are required.

In those factors, the more the number of the values (data) under conditions similar to the actual conditions becomes, the more accurate the obtained calculation result becomes. Preferably, the values under the actually used conditions are manually input by a user via the panel of the image forming apparatus or a computer or by sensing using a sensor.

As described above, in the real-time calculations to be performed during the printing, by using the actual value of at least one of the temperature of the fixing member, the temperature of the pressing member, and the temperature of the recording medium before fixing, it may become possible to highly-accurately control the temperature of the recording medium after fixing.

According to an embodiment, preferably, a thermal fixing device may use the temperature control method described above (according to an embodiment).

According to an embodiment, preferably, an image forming apparatus may include the thermal fixing device described above (according to an embodiment).

According to an embodiment, the algorithm of the difference method calculation to calculate the temperature of the recording medium after fixing is separated into calculations to be calculated before printing (fixing) and the calculations to be calculated during the printing in real time, so that, in the printing, a desired temperature of the recording medium after fixing is accurately calculated, thereby enabling controlling to obtain substantially constant fixing quality.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

For example, the configuration of the image forming apparatus according to an embodiment may have an arbitrary configuration. Namely, for example, the present invention is not limited to the tandem-type, and the present invention may also be applied to any other configuration such as revolver type. Further, for example, the present invention may also be applied to a full-color apparatus using three colors, a color apparatus using two colors, and a monochrome apparatus. Needless to say, the image forming apparatus according to an embodiment is not limited to a copier but may also be applied to a printer, a facsimile machine, a multi-functional peripheral and the like.

What is claimed is:

1. A temperature control method of calculating a temperature of a recording medium used in a thermal fixing device including a fixing member and a pressing member, the temperature control method comprising:

performing first-stage calculations before a start of printing by:

dividing a region of a nip section of the thermal fixing device including the fixing member, the recording medium, and the pressing member into plural discrete points that include discrete points in respective areas of each of the fixing member, the recording medium, and the pressing member, and calculating temperatures of the plural discrete points using difference method calculations; and performing second-stage calculations in real time during fixing to calculate a result of the temperature of the recording medium in a state where fixing is finished, wherein the result of the temperature of the recording medium in the state where fixing is finished is used to control obtaining a desired temperature of the recording medium in the state where fixing is finished, wherein the result of the temperature of the recording medium in the state where fixing is finished is calculated based on a calculation of heat transfer between the plural discrete points in the nip section without directly measuring an actual temperature of the recording medium in the state where fixing is finished.

2. The temperature control method according to claim 1, further comprising:

controlling at least a temperature of a fixing member by using the result of the temperature of the recording medium in the state where fixing is finished.

3. The temperature control method according to claim 2, wherein, in the controlling, the result of the temperature of the recording medium in the state where fixing is finished is set as a target control temperature, and at least the temperature of the fixing member is determined based on a detected temperature of the fixing member and temperature information of a pressing member.

4. The temperature control method according to claim 1, wherein, in the first-stage calculations, at least one of a nip time of the thermal fixing device, a basis weight of the recording medium, a heat transfer rate of the recording medium, a specific heat of the recording medium, and a water content rate of the recording medium is used.

5. The temperature control method according to claim 1, wherein, in the second-stage calculations, an actual value of at least one of a temperature of a fixing member, a temperature of a pressing member, and a temperature of the recording medium before fixing is used.

6. A thermal fixing device, wherein the temperature control method according to claim 1 is used.

7. An image forming apparatus comprising:

the thermal fixing device according to claim 6.

8. The temperature control method according to claim 1, wherein the plural discrete points are discontinuously arranged in the region of the nip section.

* * * * *